United States Patent [19]

Glennon et al.

[11] 4,164,033

[45] Aug. 7, 1979

[54] COMPRESSOR SURGE CONTROL WITH AIRFLOW MEASUREMENT

[75] Inventors: Timothy F. Glennon; Theodore E. Sarphie; Dennis T. Faulkner, all of Rockford, Ill.

[73] Assignee: Sundstrand Corporation, Rockford, Ill.

[21] Appl. No.: 833,031

[22] Filed: Sep. 14, 1977

[51] Int. Cl.[2] ..... F04D 27/02; F02C 9/14

[52] U.S. Cl. ..... 364/431; 60/39.29; 415/17; 415/39

[58] Field of Search ..... 364/431; 340/27 SS; 415/27, 28, 17, 39; 73/115-117

[56] References Cited

U.S. PATENT DOCUMENTS

| | | | |
|---|---|---|---|
| 3,138,317 | 6/1964 | Jekat | 415/148 |
| 3,292,845 | 12/1966 | Hens et al. | 415/17 |
| 3,292,846 | 12/1966 | Harper et al. | 415/17 |
| 3,411,702 | 11/1968 | Metot et al. | 415/27 |
| 3,424,370 | 1/1969 | Law | 415/27 |
| 3,852,958 | 12/1974 | Adams et al. | 340/27 SS |
| 3,867,717 | 2/1975 | Moehring et al. | 364/431 |
| 3,868,625 | 2/1975 | Speigner et al. | 340/27 SS |
| 3,935,558 | 1/1976 | Miller et al. | 340/27 SS |
| 4,060,980 | 12/1977 | Elsaesser et al. | 60/39.29 |
| 4,077,203 | 3/1978 | Burnell | 60/39.29 |

*Primary Examiner*—Felix D. Gruber

*Attorney, Agent, or Firm*—Wegner, Stellman, McCord, Wiles & Wood

[57] ABSTRACT

Surge control systems are provided for compressors which supply air to a pneumatic load. A signal proportional to the pressure ratio of the outlet pressure to the inlet pressure plus a selected reference pressure is compared to a measured weight flow rate of air through the compressor to provide a vent valve command signal. If the measured pressure ratio plus the reference pressure ratio exceeds the measured flow rate, a surge condition may ensue. The vent valve position command signal causes a venting valve to vent a portion of the air provided to the load, which reduces the measured pressure ratio and increases weight flow rate. During normal operation of the compressor, the vent valve command signal is zero for all values of weight flow rate. A transient control channel is provided which is responsive to the rate of change of the measured pressure ratio and/or measured weight flow rate.

11 Claims, 3 Drawing Figures

COMPRESSOR SURGE CONTROL WITH AIRFLOW MEASUREMENT

BACKGROUND OF THE INVENTION

This invention relates to control systems for controlling the operation of gas compressor systems to avoid a surge condition and, more particularly, to a system for regulating the ratio of the outlet pressure to the inlet pressure and the measured weight flow rate to prevent surge.

Gas compressor systems which supply air pressure to pneumatic loads are subject to the occurrence of an undesirable condition commonly referred to as surge. Although the reason for the occurrence of surge is not fully understood, its effect is extremely detrimental. For example, when a surge condition occurs in the compressor system, the airflow may suddenly reverse and air provided to the pneumatic load may cease or be interrupted. If the surge condition is permitted to continue, the compressor can enter a deep surge condition causing damage to its internal components.

SUMMARY OF THE INVENTION

In accordance with the present invention, surge control is effected by comparing a measured pressure ratio (of the outlet pressure to the inlet pressure) plus a signal representing a reference pressure ratio to a measured weight flow rate of air through the compressor. If the measured pressure ratio plus the reference pressure ratio exceeds the measured flow rate, a surge condition may ensue and a vent valve position command signal causes a venting valve to vent a portion of the air provided to the load. The venting of the air reduces the output pressure from the compressor, thereby lowering the measured pressure ratio and increasing the measured weight flow rate. As the pressure ratio returns toward a value equal to the reference pressure for the measured flow rate, the valve position command signal begins to cause the valve to close, and system operation along the operating line resumes.

During normal operation of the compressor, the vent valve command signal is zero at all points along the operating line of the compressor's surge map which is indicative of the reference pressure ratio plus the measured pressure ratio equaling the measured weight flow rate. The measured weight flow rate of the air through the compressor may be adjusted to correct for pressure and temperature variations. Also, a transient control channel, responsive to the rate of change of the measured pressure ratio and/or measured weight flow rate, may be provided to fully vent the air if the rate of change of the pressure ratio and/or weight flow rate increases to a level indicative of an ensuing surge condition. The effect of the reference pressure ratio is reduced to correspond to a lesser weight flow rate through the compressor which occurs as a result of decreasing the speed or repositioning the inlet guide vanes.

It is an object of this invention to provide an electrical or electronic control system for preventing and controlling a surge condition in compressor systems.

Another object of the invention is to control surge by controlling the pressure ratio of the outlet pressure to the inlet pressure and to control weight flow rates of air through the compressor.

Yet another object is to provide a surge control signal if the rate of change of the pressure ratio and/or weight flow rate with respect to time exceeds a selected value.

Other objects and features of the invention will be apparent from the following description and from the drawings. While illustrative embodiments of the invention are shown in the drawings and will be described in detail herein, the invention is susceptible of embodiment in many different forms and it should be understood that the present disclosure is to be considered as an exemplification of the principles of the invention and is not intended to limit the invention to the embodiments illustrated.

DESCRIPTION OF THE PREFERRED EMBODIMENT

Figure 1:
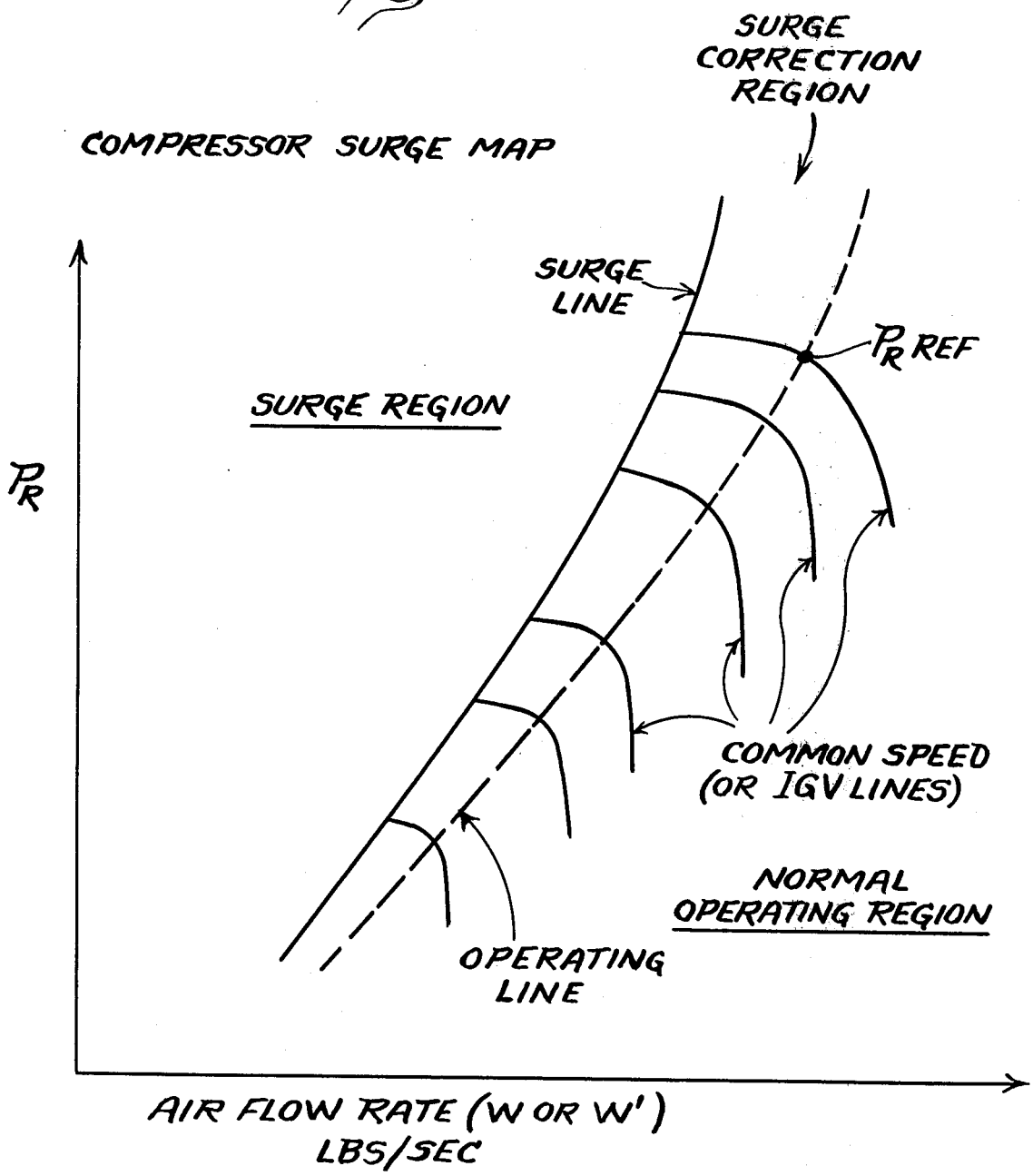
FIG. 1 is a diagram of a compressor surge map for the type of compressor contemplated by the present invention.

Referring to FIG. 1, a surge map for a load compressor is shown. The map shows a pressure ratio $P_r$ plotted as a function of airflow rate W or corrected airflow rate, W'. $P_r$ is the ratio of the outlet pressure, $P_{out}$, to the inlet pressure, $P_{in}$, and the partially corrected airflow rate W' (or airflow rate W) is the weight of the air discharged from the compressor as a function of time (as for example lbs. per second).

Both $P_r$ and W' are obtained by measuring various compressor parameters. $P_{in}$ may be obtained by measuring the pressure at the inlet of the compressor by a pressure tube. $P_{out}$ may be similarly measured by a pressure tube positioned at the outlet of the compressor. The pressures are converted to electrical signals which are manipulated to provide $P_r$. Partially corrected airflow rate W' (and airflow rate W) is proportional to a differential pressure measured at either the inlet or the outlet of the compressor. Hence, a differential pressure may be converted to an electrical signal and multiplied by a constant to provide W'.

The surge line on the map is acquired empirically by detecting and plotting values of $P_r$ at which the compressor enters a surge condition for selected values of W'. The speed of the compressor and the position of its inlet guide vanes (IGV) affect the location of the operating position on the map, and movement on the map is along the common speed or common IGV line. For example, at a constant compressor speed, $P_r$ increases with a decrease in airflow rate until the compressor reaches a surge condition, as can be seen by following the common speed line upwardly and to the left to the surge line as shown in FIG. 1. The magnitude of $P_r$ for a given W' can be controlled by controlling the pressure at the outlet $P_{out}$ for a particular flow rate. This may be accomplished by venting a portion of the air provided to the load. As the air is vented, $P_{out}$, and hence $P_r$, drops following the common speed line to the right and downwardly from the surge line to the operating line for the compressor. The compressor operating line is drawn in the normal operating region of the map and is selected to represent a displacement, such as 5% for example, to the right of the surge line. It is desirable that the system maintain a pressure ratio $P_r$ equal to or greater than the $P_r$ value at the intersection of the operating line with the common speed line (or inlet guide vane position line) but less than the $P_r$ value at the intersection of the surge line and the common speed line.

In the present invention, the pressure ratio $P_r$ is controlled by a venting valve which increases or decreases the output pressure $P_{out}$ and weight flow rate W so that $P_r$ equals the $P_r$ value at the intersection of the common speed line with the operating line. The venting valve is controlled when the $P_r$ value is in the surge correction region as shown in FIG. 1. The position of the valve determines the value of $P_r$ and W and is controlled by a surge control circuit to be explained in greater detail below.

If the compressor is operating in surge condition (i.e., on the surge line), the valve is fully opened to most rapidly reduce $P_r$ and increase W. If the compressor is operating in the normal operating region (i.e., on the operating line), the valve is fully closed. As the venting valve is opened, the pressure ratio $P_r$ drops and the weight flow rate W increases along the common speed line (or along the common IGV line) toward the point of intersection with the normal operating line. As the pressure ratio approaches a value representing the normal operating line, the surge control circuit of the present invention proportionally closes the valve and completely closes it when the pressure ratio $P_r$ lies at the intersection of the operating line. Thereafter, if the pressure ratio increases to enter the surge correction region, the control valve is opened in an amount proportional to the magnitude of the correction required to drop the pressure ratio $P_r$ back toward the intersection with the operating line.

An explanation of the operation of various control systems for the compressors will now be provided with particular reference to a centrifugal compressor having a backward curved impeller which has an extended choke to stall range and within that range an appreciable zone of constant pressure variable flow. Although the centrifugal compressor will be described in combination with the control circuits, it should be understood that the control circuits of the present invention are capable of controlling surge for any type of compressor having a surge map similar to that shown in FIG. 1.

Figure 2:
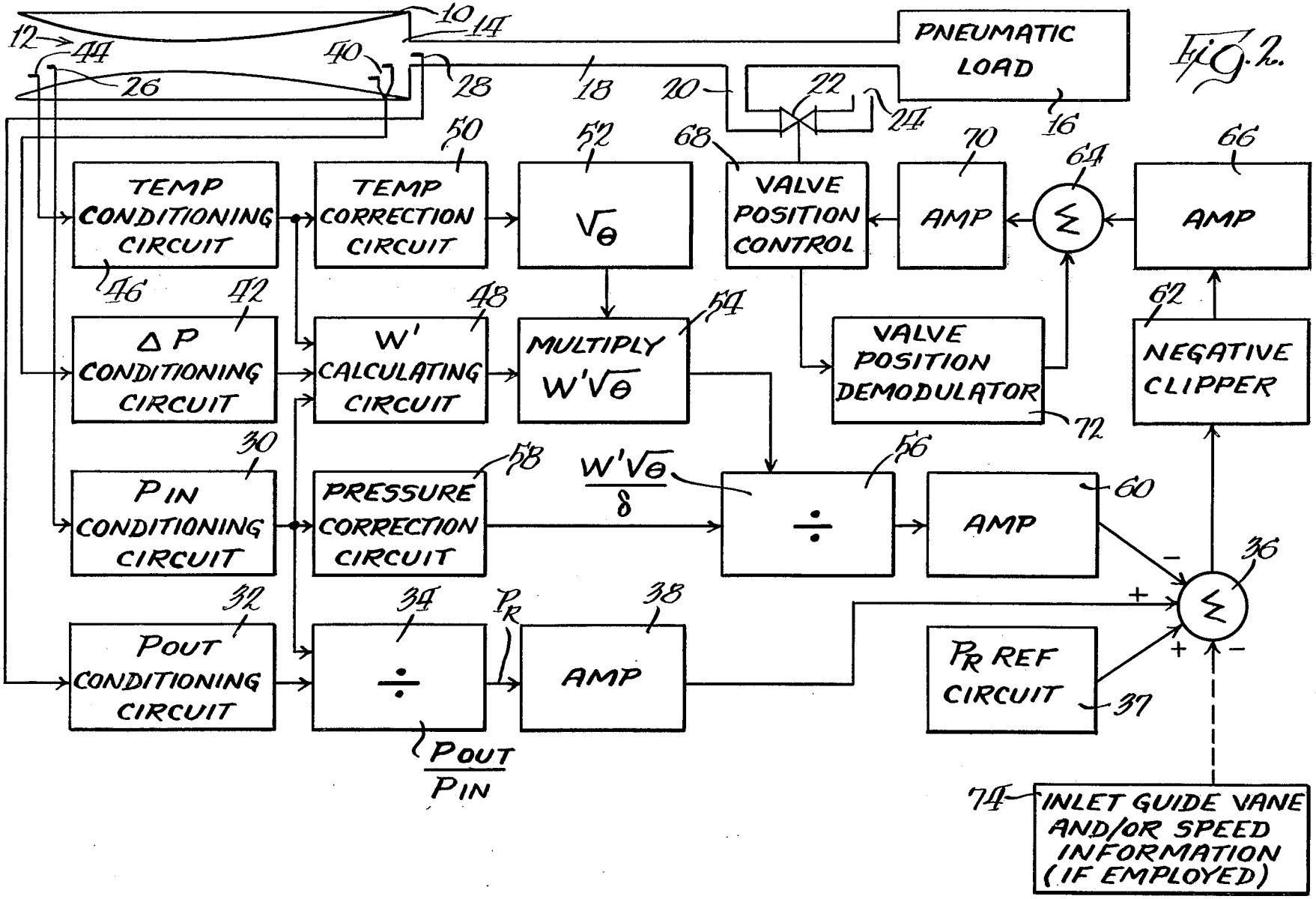
FIG. 2 is a block diagram of a surge control system wherein the pressure differential $\Delta p$ is measured at the outlet of the compressor.

Referring to FIG. 2, a surge control system for a fixed speed, fixed geometry compressor is shown. A compressor 10 has an inlet 12 and an outlet 14 which supplies compressed air to pneumatic load 16 by a pneumatic conduit 18 which is coupled between the load 16 and the outlet 14. A venting conduit 20 is coupled in parallel with load 16 and has a dump valve 22 therein. The position of valve 22 determines the amount of airflow from outlet 14 to a vent 24.

A pressure sensor 26, which may be a conventional transducer or a strain gauge, measures the pressure at inlet 12 and converts it to a signal representative of the amplitude of the pressure at that point. Similarly, a sensor 28 measures the pressure at outlet 14 and provides a signal $P_{out}$ proportional to its magnitude. The signals representing $P_{in}$ and $P_{out}$ are applied to conditioning circuits 30 and 32, respectively. The conditioning circuits remove noise and transients from the signals. The signals are then applied to a divider circuit 34 to divide the signal representing the outlet pressure $P_{out}$ by a signal representing the input pressure $P_{in}$. The output from divider circuit 34, $P_r$, is applied to a summer 36 through an amplifier 38. The selection of the gain of amplifier 38 will be discussed in greater detail below.

The partially corrected weight flow W' can be expressed in the form of an equation as follows:

$$W' = c\sqrt{\Delta p\left(\frac{P_{in}}{T_{in}}\right)} \qquad \text{(EQ 1)}$$

where c is a selected airflow constant, $\Delta p$ is the pressure difference at the outlet of the compressor, $P_{in}$ is the inlet pressure, and $T_{in}$ is the inlet temperature. Also, W' can be corrected for temperature and pressure by multiplying it by the $\sqrt{\theta/\delta}$ to equal $W'\sqrt{\theta/\delta}$ wherein $\theta$ is equal to $T_{in}/519.7°$ K. (EQ 2) and $\delta$ is $P_{in}/14.7$ (EQ 3). The multiplication of W' by the correction values assures that a more accurate weight flow rate is obtained.

Returning to FIG. 2, a sensor 40, located in outlet 14, senses $\Delta p$. The $\Delta p$ signal is provided to a $\Delta p$ conditioning circuit 42 to remove noise. Also, temperature sensor 44 located at the inlet 12 senses the temperature and generates a signal proportional to it which is applied to temperature conditioning circuit 46. W' calculation circuit 48 receives the signals representing temperature, $\Delta p$ and input pressure $P_{in}$ from conditioning circuits 46, 42 and 30, respectively. The circuit manipulates C, $\Delta p$, $P_{in}$ and $T_{in}$ to provide an output representing W' as in Equation 1, above.

Temperature and pressure correction of W' will now be considered. Temperature correction circuit 50 multiplies the signal received from temperature conditioning circuit 46 by an amount equal to that shown in Equation 2. The output from temperature correction circuit 50 is applied to a square root circuit 52 which obtains the square root of the value of the signal from the temperature correction circuit 50. The value from the square root circuit 52 is multiplied by W' by multiplier 54. The product therefrom is provided to divide circuit 56. Also provided to divide circuit 56 is the signal representing $\delta$ from pressure correction circuit 58. The output from pressure correction circuit 58 is represented by Equation 3. The output from divide circuit 56 is applied to summer 36 through an amplifier 60. The selection of the gain of amplifier 60 will be discussed in greater detail below.

A signal representing $P_r$ ref is provided by $P_r$ ref circuit 37 and applied to algebraic amplifier or summer 36. The signal from summer 36 is the sum of the negative signal from amplifier 60, the positive signal from amplifier 38 and the positive signal $P_r$ ref from circuit 37. The signal from summer 36 will be hereinafter referred to as the vent valve command signal and may be expressed in the form of an equation as $$P_r + P_r\,\text{ref} - \frac{W'\sqrt{\theta}}{\delta} \qquad \text{(EQ 4)}$$

The polarity of the signal is indicative of whether or not the system is operating in the surge correction region or in the normal operating region about a selected reference pressure $P_r$ as shown in FIG. 1. That is to say, if the vent valve command signal is positive, the magnitude of the $P_r$ term exceeds the magnitude of the W' term at a selected reference pressure $P_r$ ref, and the operation of the compressor is operating in the surge correction region on the map in FIG. 1. If, however, the vent valve command signal is negative, the W' term is greater than the $P_r$ term plus the $P_r$ ref term, and the compressor is operating in the normal operating region of the map shown in FIG. 1. When $P_r$ plus $P_r$ ref equals the W' term, a zero output is provided from the summer which is an indication of the compressor operating on the operating line. The gains of amplifiers 38 and 60 are selected to balance the signals into summer 36 so that the output from summer 36 is zero everywhere on the selected operating line. In effect, this adjustment amounts to establishing the slope of the operating line.

The vent valve command signal from summer 36 controls the position of the valve 22. A negative signal indicates normal operation, as discussed above, and is removed by a negative clipper circuit 62. A positive signal passes through the negative clipper circuit 62 and is applied to a summer 64 through an amplifier 66. The gain of amplifier 66 is selected in accordance with the operating characteristics of the system. The positive voltage applied to summer 64 causes an output voltage to be provided to a valve position control circuit 68 through an amplifier 70. The position of the valve is related to the voltage applied to the valve position control circuit 68 in any convenient manner. For example, the positive voltage applied to the valve position control circuit 68 opens valve 22 in an amount proportional to the magnitude of the positive voltage. Zero volts causes valve 22 to be fully closed. A valve position demodulator circuit 72 provides feedback to summer 64 in a well known manner to assure that the valve position with respect to the applied voltage is maintained.

A variable speed or variable geometry compressor may be employed in lieu of fixed speed, fixed geometry compressor 10 discussed above. In such a situation, the calculated surge line must be shifted as required for a given inlet guide vane position or a selected speed. This may be most easily accomplished by adding a signal representative of the shift to summer 36 by an inlet guide vane or speed information circuit 74.

Figure 3:
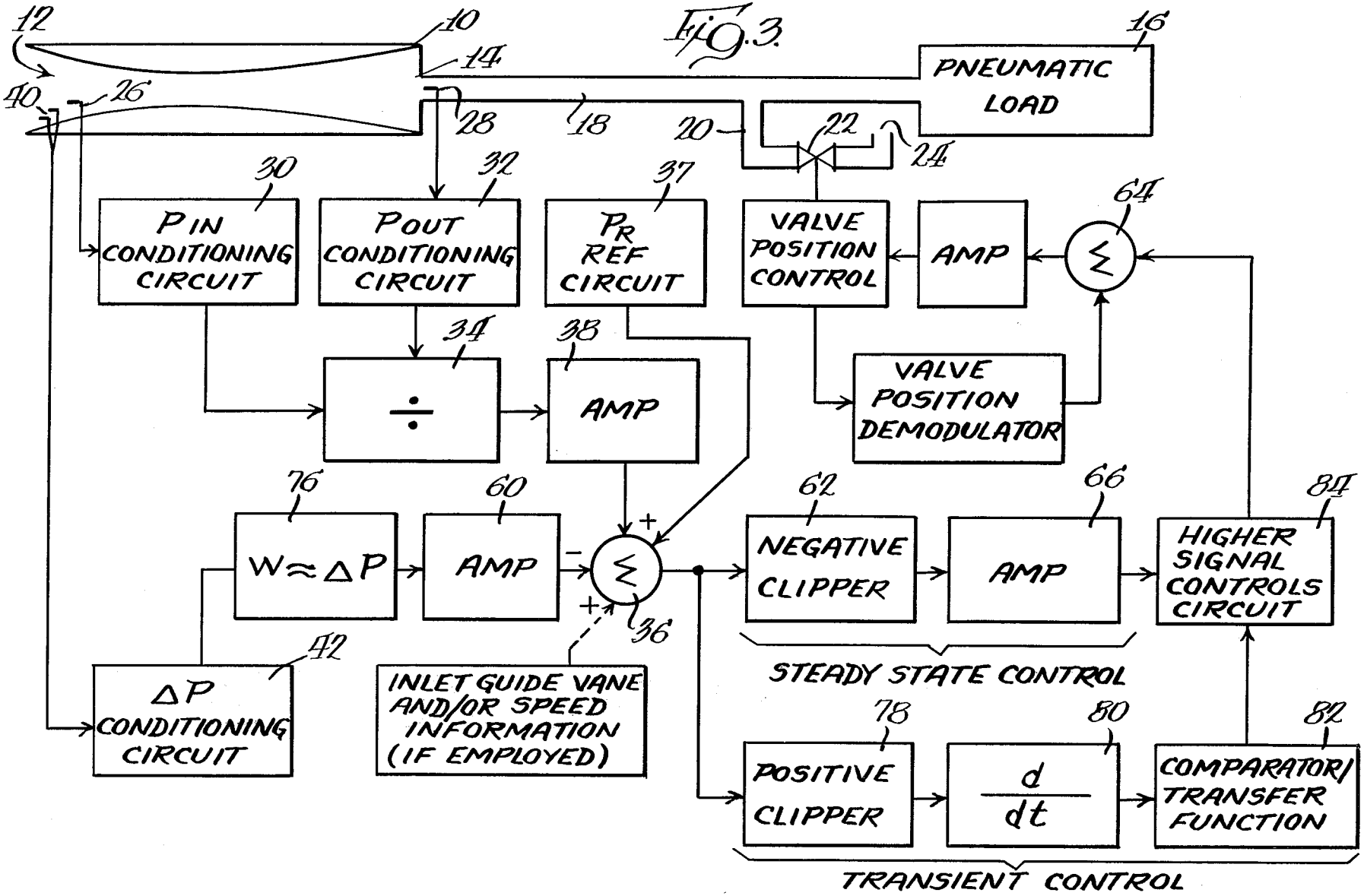
FIG. 3 is a block diagram of a surge control system wherein $\Delta p$ is measured at the inlet of the compressor, and transient control is also provided.

Referring to FIG. 3, another surge control circuit is shown. Circuits which are similar to that disclosed in FIG. 2 are similarly numbered. Also, an alternative method of acquiring the airflow rate and the $P_r$ value will be described, it being understood that the circuitry described in FIG. 2 to provide such signals would be equally effective.

The input to summer 36 includes W, $P_r$ and $P_r$ ref. $P_r$ and $P_r$ ref are provided in a manner similar to that discussed above. W is obtained by a circuit 76 which multiplies $\Delta p$ (taken at the inlet 12 rather than the outlet 14, as previously considered) by a constant. If $\Delta p$ is acquired from the input, temperature and pressure factors are minimal, and in most cases correction circuitry need not be provided.

The valve position command signal from summer 36 is provided to negative clipper 62 for steady state control in a manner discussed above. Also, the valve command signal is applied in parallel to a positive clipper 78 which removes positive signals and passes negative signals which represent operation in the normal operating region. The surge command signal increases at a high rate as the pressure ratio $P_r$ increases for a given weight flow rate W. A high rate of increase is a precursor to the surge condition. Thus, if d/dt from a circuit 80 increases beyond a level established by a comparator/transfer function circuit 82, 82 provides a signal having a high gain to summer 64 through a circuit 84. The signal is of a sufficient magnitude to fully open valve 22 in a short period of time, as 15$\mu$ seconds. The output of circuit 82 then slowly returns to its original level after a period of time delay, such as 3 seconds, causing valve 22 to close. A higher signal controls circuit 84 and passes only the larger of the two input signals to effect transient and steady state control.

We claim:

1. A surge control system for a compressor which provides air to a pneumatic load comprising:

means for generating a pressure ratio signal proportional to a ratio of the outlet pressure of the compressor to the inlet pressure of the compressor;

means for generating a signal proportional to the weight flow rate of the air through the compressor;

means for providing a vent valve command signal if the pressure ratio signal deviates from said weight flow rate signal by a predetermined amount; and a vent valve position control responsive to said vent valve command signal for regulating the position of a valve which controls the flow of the air through the compressor.

2. The surge control system of claim 1 further including:

means for adjusting the level of said weight flow rate signal and means for adjusting the level of said pressure ratio signal so that said vent valve command signal may be reduced to zero along a selected compressor operating line for all values of weight flow rate.

3. The surge control system of claim 1 wherein said means for providing a vent valve command signal further includes:

a clipper circuit for passing said vent valve command signal of a polarity indicative of said pressure ratio signal exceeding said weight flow rate signal by a predetermined amount.

4. The system of claim 1 further including:

means for differentiating the vent valve command signal with respect to time to provide a differential signal;

means for comparing said differential signal with a differential reference signal; and the vent valve position control includes means for generating a signal to cause said valve to open if said differential signal exceeds said differential reference signal.

5. The surge control system of claim 4 further including:

a clipper circuit coupled between said means for summing and said means for differentiating for passing said vent valve command signal of a polarity indicative of said weight flow rate signal exceeding said pressure ratio signal by a predetermined amount and inhibiting said vent valve command signal of a polarity indicative of said pressure ratio signal exceeding said weight flow rate signal by a predetermined amount.

6. The surge control system of claim 4 wherein said means for generating a signal to cause said valve to open if said differential signal exceeds said differential reference signal also causes said valve to remain open for a selected time after said differential signal ceases to exceed said differential reference signal.

7. The compressor of claim 1 wherein said means for generating a signal proportional to said pressure ratio includes:

means for providing a signal representative of the inlet pressure;

means for providing a signal representative of the outlet pressure; and means for dividing said signal representative of the outlet pressure by said signal representing the inlet pressure to provide a signal proportional to the pressure ratio.

8. The system of claim 3 wherein said means for generating a signal proportional to weight flow rate includes:

means for generating a signal representative of a pressure difference $\Delta p$ at the outlet of the compressor;

means for generating a signal proportional to the inlet pressure of the compressor;

means for generating a signal proportional to the temperature at the inlet of the compressor;

means for generating a signal $$W' = c\sqrt{\Delta p\left(\frac{P_{in}}{T_{in}}\right)}$$

wherein c is a constant, $P_{in}$ is the inlet pressure and $T_{in}$ is the inlet temperature;

means for dividing $T_{in}$ by a constant to provide a temperature correction factor $\theta$;

means for providing $\sqrt{\theta}$;

means for dividing $P_{in}$ by a constant to provide a pressure correction factor $\delta$;

means for multiplying W' by $\sqrt{\theta}$ to provide $W'\sqrt{\theta}$; and means for dividing $W'\sqrt{\theta}$ by $\delta$ to provide $W'\sqrt{\theta}/\delta$.

9. The system of claim 1 wherein said means for generating a signal proportional to the weight flow rate includes:

means for generating a signal representative of a pressure difference $\Delta p$ at the inlet of the compressor; and means for multiplying said signal representative of a pressure difference $\Delta p$ at the inlet by a constant to provide the signal proportional to the actual weight flow rate.

10. The surge control system of claim 3 wherein the vent valve position control causes said vent valve to open an increased amount in response to an increased magnitude of said vent valve command signal to vent a greater amount of air to the pneumatic load as the magnitude of the vent valve command signal increases.

11. A surge control system for a compressor which provides air to a pneumatic load comprising:

means for generating a signal proportional to a pressure ratio of said outlet pressure of the compressor to the inlet pressure of the compressor;

means for establishing a signal proportional to a reference pressure ratio;

means for generating a signal proportional to the actual weight flow rate of the air through the compressor;

means for summing said pressure ratio signal with said weight flow rate signal and said reference pressure ratio signal;

means for providing a vent valve command signal if the pressure ratio signal plus said reference pressure ratio signal exceeds said weight flow rate signal;

means for differentiating the vent valve command signal with respect to time to provide a differential signal;

means for comparing said differential signal with a differential reference signal;

means for generating a valve open signal if said differential signal exceeds said differential reference signal; and a vent valve position control responsive to said vent valve command signal and to said valve open signal for regulating a valve which vents a portion of the air to the pneumatic load in an amount proportional to said vent valve command signal.

* * * * *